US011298665B2

(12) United States Patent
Omachi et al.

(10) Patent No.: US 11,298,665 B2
(45) Date of Patent: Apr. 12, 2022

(54) APPARATUS AND METHOD FOR MIXING PASTE MATERIAL WITH GAS

(71) Applicant: SUNSTAR ENGINEERING INC., Osaka (JP)

(72) Inventors: Takuro Omachi, Osaka (JP); Hiroyuki Nagata, Osaka (JP)

(73) Assignee: SUNSTAR ENGINEERING INC., Osaka (JP)

( * ) Notice: Subject to any disclaimer, the term of this patent is extended or adjusted under 35 U.S.C. 154(b) by 588 days.

(21) Appl. No.: 16/323,104

(22) PCT Filed: Aug. 2, 2017

(86) PCT No.: PCT/JP2017/027971
§ 371 (c)(1),
(2) Date: Feb. 4, 2019

(87) PCT Pub. No.: WO2018/025890
PCT Pub. Date: Feb. 8, 2018

(65) Prior Publication Data

US 2019/0184355 A1 Jun. 20, 2019

(30) Foreign Application Priority Data

Aug. 5, 2016 (JP) ..... JP2016-154868

(51) Int. Cl.
*B01F 5/00* (2006.01)
*B01F 3/04* (2006.01)
(Continued)

(52) U.S. Cl.
CPC ..... *B01F 15/02* (2013.01); *B01F 3/04* (2013.01); *B01F 5/00* (2013.01); *B01F 5/06* (2013.01)

(58) Field of Classification Search
CPC ..... B01F 3/04; B01F 5/06; B01F 15/02
See application file for complete search history.

(56) References Cited

U.S. PATENT DOCUMENTS 5,480,589 A 1/1996 Belser et al.
8,926,623 B2 * 1/2015 Trieu ..... A61B 17/70 606/94

FOREIGN PATENT DOCUMENTS

JP 06-198152 7/1994
JP 09-094450 4/1997
(Continued)

OTHER PUBLICATIONS

International Search Report dated Nov. 7, 2017 in International (PCT) Application No. PCT/JP2017/027971.

*Primary Examiner* — Robert A Hopkins
(74) *Attorney, Agent, or Firm* — Wenderoth, Lind & Ponack, L.L.P.

(57) ABSTRACT

An apparatus (1) for mixing a paste material with gas includes: a mixing part (2) that mixes the paste material with the gas using a piston pump (10); and a static mixer (3) that is connected to the mixing part to stir a mixture obtained by mixing the paste material with the gas in the mixing part. The static mixer includes one or a plurality of stirring sections through which the mixture passes, the stirring section has a shape that allows a flow of the mixture passing through the stirring section to be stirred. A ratio of a volume of the piston pump to a volume of at least one of the stirring sections of the static mixer is within a range from 1:0.2 to 1:5.

20 Claims, 9 Drawing Sheets

(51) Int. Cl.
*B01F 15/02* (2006.01)
*B01F 5/06* (2006.01)

(56) References Cited

FOREIGN PATENT DOCUMENTS

| | | | |
|---|---|---|---|
| JP | 10-506572 | | 6/1998 |
| JP | 11-128709 | | 5/1999 |
| JP | 2003171471 A | * | 6/2003 |
| JP | 2006-289276 | | 10/2006 |

* cited by examiner

APPARATUS AND METHOD FOR MIXING PASTE MATERIAL WITH GAS

TECHNICAL FIELD

The present invention relates to an apparatus and a method that mix a paste material with gas for the purpose of foaming the paste material.

BACKGROUND ART

There has been conventionally known a technique of manufacturing a foam gasket, etc. by mixing a paste material with gas. In such a technique, it is important that fine bubbles of the gas are evenly dispersed in the paste material so that both are sufficiently mixed. There is known a technique of using a static mixer after mixing the paste material with the gas to disperse the gas in the paste material more efficiently. Note that a so-called high-viscosity material is also included in the paste material.

For example, a high-viscosity material foaming apparatus disclosed in PTL 1 described below includes a material supply conduit 2 through which the high-viscosity material discharged from a material supply pump 1 flows, a gas supply conduit 3 that supplies gas from a predetermined position of the material supply conduit 2 to mix the gas into the high-viscosity material flowing through the material supply conduit 2, first and second pumps 4, 5 serving as material flow means that are provided on the upstream side and the downstream side of a gas mixing position of the material supply conduit 2, respectively, a first static mixer 6 serving as a first dispersion conduit that is provided on the downstream side of the second pump, a second static mixer 7 serving as a second dispersing conduit that is provided on the downstream side of the first static mixer 6, and a material discharge conduit 8 that is provided on the downstream side of the second static mixer 7.

CITATION LIST

Patent Literature

PTL 1: Japanese Patent Laid-Open No. 2006-289276

SUMMARY OF INVENTION

Technical Problem

However, PTL 1 discloses that the first and second static mixers 6, 7 are used, but does not disclose how the first and second static mixers 6, 7 should be configured with respect to the material supply conduit 2 in which the gas is mixed into the high-viscosity material at the gas mixing position to improve the mixing efficiency.

According to the experiment using the static mixers, it has been shown that the gas cannot be necessarily efficiently mixed into the high-viscosity material. The experiment result shows that sizes of the bubbles of gas become larger, resulting in a cured foamed product being non-uniform, or variation in a mixing amount of the gas is caused, resulting in variation in the foam ratio of the cured foamed product, and suggests that the stirring efficiency is insufficient.

The present invention has been made in view of the above-described points, and an object thereof is to improve an stirring efficiency in an apparatus and a method that mix a paste material with gas using a static mixer.

Solution to Problem

In order to solve the above-described problems, an apparatus for mixing a paste material with gas of the present invention includes: a mixing part that mixes the paste material with the gas using a piston pump; and a static mixer that is connected to the mixing part to stir a mixture obtained by mixing the paste material with the gas in the mixing part, in which the static mixer includes one or a plurality of stirring sections through which the mixture passes, the stirring section has a shape that allows a flow of the mixture passing through the stirring section to be stirred, and further the static mixer is a static mixer according to any of a first aspect in which a ratio of a volume of the piston pump to a volume of at least one of the stirring sections of the static mixer is within a range from 1:0.2 to 1:5 and a second aspect in which at least one of the stirring sections has a configuration in which the flow of the mixture is split into five or more streams to stir the mixture of the paste material and the gas by a shear force.

The piston pump according to one aspect includes: a cylinder; a discharge port formed at an end of the cylinder in order to make the cylinder communicate with a conduit through which the paste material can flow; a suction port formed in the cylinder in order to fill the cylinder with gas; and a piston slid between a first position and a second position inside the cylinder, in which the mixing part includes a discharge valve that opens and closes the discharge port, the cylinder forms a cylinder space having a predetermined volume when the piston is located at the first position, and the static mixer is connected to the conduit.

A series of steps from closing the discharge valve to opening the discharge valve is repeated whenever a predetermined amount of the paste material flows.

A foam ratio of the paste material is controlled by adjusting at least any of the predetermined amount of the paste material, the predetermined volume of the cylinder space, and a predetermined pressure of the gas.

The discharge port is provided so as to face a flow of the paste material in a side wall of the conduit, and the discharge valve includes a valve body that can extend from a position of the side wall of the conduit to seat at the discharge port, the position being opposed to the discharge port.

The piston pump according to another aspect includes: a cylinder; and a piston that reciprocates in the cylinder to perform a suction step and a discharge step, in which the cylinder includes a valve for controlling discharge that is provided at a stroke end of the discharge step, a valve for controlling gas supply, and a valve for controlling paste material supply, and a volume of the piston pump is a volume of an interior of the cylinder defined by the piston that is located at the stroke end in the suction step.

The mixing part using a piston pump according to another aspect executes each of the steps of: supplying the gas to the piston pump in a suction step; supplying the paste material after the suction step; and performing a discharge step of the piston pump after end of the supply of the paste material to discharge the gas and the paste material to a conduit.

The stirring section of the static mixer includes static stirring means. Preferably, in the first aspect of the static mixer, the stirring means includes actions of splitting, turning and inverting of a flow of a mixture. For example, the stirring means has a helical shape. Alternatively, the stirring means may be a plurality of baffle plates that are alternately arranged in the static mixer against the flow of the mixture.

In a preferred second aspect of the static mixer, the stirring means includes five or more flow paths, in which each of the flow paths is arranged in parallel to the flow of the mixture. For example, in the second aspect, the stirring means is one baffle plate that is arranged in the static mixer against the flow of the mixture, and a plurality of through-holes through which the flow of the mixture passes may be formed in the baffle plate. In another example, an interior of the static mixer may be formed in a honeycomb shape, or a plurality of pipes may be arranged in parallel inside the mixer.

In order to improve a dispersion efficiency, a pipe having a predetermined length is provided at least any of between the mixing part and the static mixer and between the static mixer and discharge means for discharging the mixture.

A method for mixing a paste material with gas of the present invention includes the steps of: mixing the paste material with the gas per batch; and arranging a static mixer in a flow path of a mixture obtained by mixing the paste material with the gas to stir the mixture, in which the step of arranging the static mixer is set to be a step of arranging a static mixer that includes one or a plurality of stirring sections through which the mixture passes, the stirring section having a shape that allows a flow of the mixture passing through the stirring section to be stirred, and further the static mixer being a static mixer according to any of a first aspect in which a ratio of a volume of the mixture per batch to a volume of a first stirring section through which the mixture at least initially passes among the stirring sections of the static mixer is within a range from 1:0.2 to 1:5 and a second aspect in which the flow of the mixture is split into five or more streams to stir the mixture of the paste material and the gas by a shear force.

In one aspect, the step of mixing the paste material and the gas per batch is set to be a step using a piston pump and a discharge valve, and the piston pump includes: a cylinder; a discharge port formed at an end of the cylinder in order to make the cylinder communicate with a conduit through which the paste material can flow; a suction port formed in the cylinder in order to fill the cylinder with gas; and a piston slid between a first position and a second position inside the cylinder, in which the discharge valve is used for opening and closing the discharge port, the cylinder forms a cylinder space having a predetermined volume when the piston is located at the first position, and the static mixer is connected to the conduit.

Preferably, the step of mixing the paste material and the gas per batch includes the steps of: closing the discharge port; forming the cylinder space having a predetermined volume in the cylinder by moving the piston to the first position; filling the cylinder space with gas having a predetermined pressure from the suction port; compressing the gas by moving the piston toward the second position; and mixing the compressed gas into the paste material that flows through the conduit by opening the discharge port, in which a series of steps from closing the discharge valve to opening the discharge valve is repeated whenever a predetermined amount of the paste material flows, the discharge port is provided so as to face a flow of high-viscosity material in a side wall of the conduit, and the step of closing the discharge port is set to be a step of extending a valve body of the discharge port from a position of the side wall of the conduit to seat the valve body at the discharge port, the position being opposed to the discharge port. For example, a flow rate sensor may be provided in order to measure a flow rate of the paste material to control to operate the piston pump by one cycle whenever a predetermined amount of flow is detected by the flow rate sensor. In addition or in the alternative, a cycle of a constant flow rate cylinder may be synchronized with a cycle of the piston pump using the constant flow rate cylinder when pumping the paste material to the conduit.

In another aspect, the step of mixing the paste material and the gas per batch is set to be a step using a piston pump, and the piston pump includes: a cylinder; and a piston that reciprocates in the cylinder to perform a suction step and a discharge step, in which the cylinder includes a valve for controlling discharge that is provided at a stroke end of the discharge step, a valve for controlling gas supply, and a valve for controlling paste material supply, and the volume of the mixture per batch is a volume of an interior of the cylinder defined by the piston that is located at the stroke end in the suction step.

Preferably, the step of mixing the paste material and the gas per batch executes each of the steps of: supplying the gas to the piston pump in the suction step: supplying the paste material after the suction step; and performing the discharge step of the piston pump after end of the supply of the paste material to discharge the gas and the paste material to a conduit.

Preferably, a step of arranging the static mixer includes a step of arranging a static mixer having static stirring means in the stirring section of the static mixer.

More preferably, in the first aspect of the static mixer, the step of arranging a static mixer having the static stirring means includes a step of splitting, turning and inverting a flow of the mixture. For example, the step of arranging a static mixer having the static stirring means uses stirring means having a helical shape. Alternatively, the stirring means may be a plurality of baffle plates that are alternately arranged in the static mixer against the flow of the mixture.

In a preferred second aspect of the static mixer, the stirring means includes five or more flow paths, in which each of the flow paths is arranged in parallel to the flow of the mixture. For example, in the second aspect, the stirring means is one baffle plate that is arranged in the static mixer against the flow of the mixture, and a plurality of through-holes through which the flow of the mixture passes may be formed in the baffle plate. In another example, an interior of the static mixer may be formed in a honeycomb shape, or a plurality of pipes may be arranged in parallel inside the mixer.

DESCRIPTION OF EMBODIMENTS

Hereinafter, an embodiment of an apparatus for mixing a paste material with gas of the present invention will be explained in detail with reference to accompanying drawings. Note that the term "paste material" as used herein refers to a fluid material having viscosity that allows the mixed gas to be finely dispersed by a shear force generated in the paste material.

Figure 1:
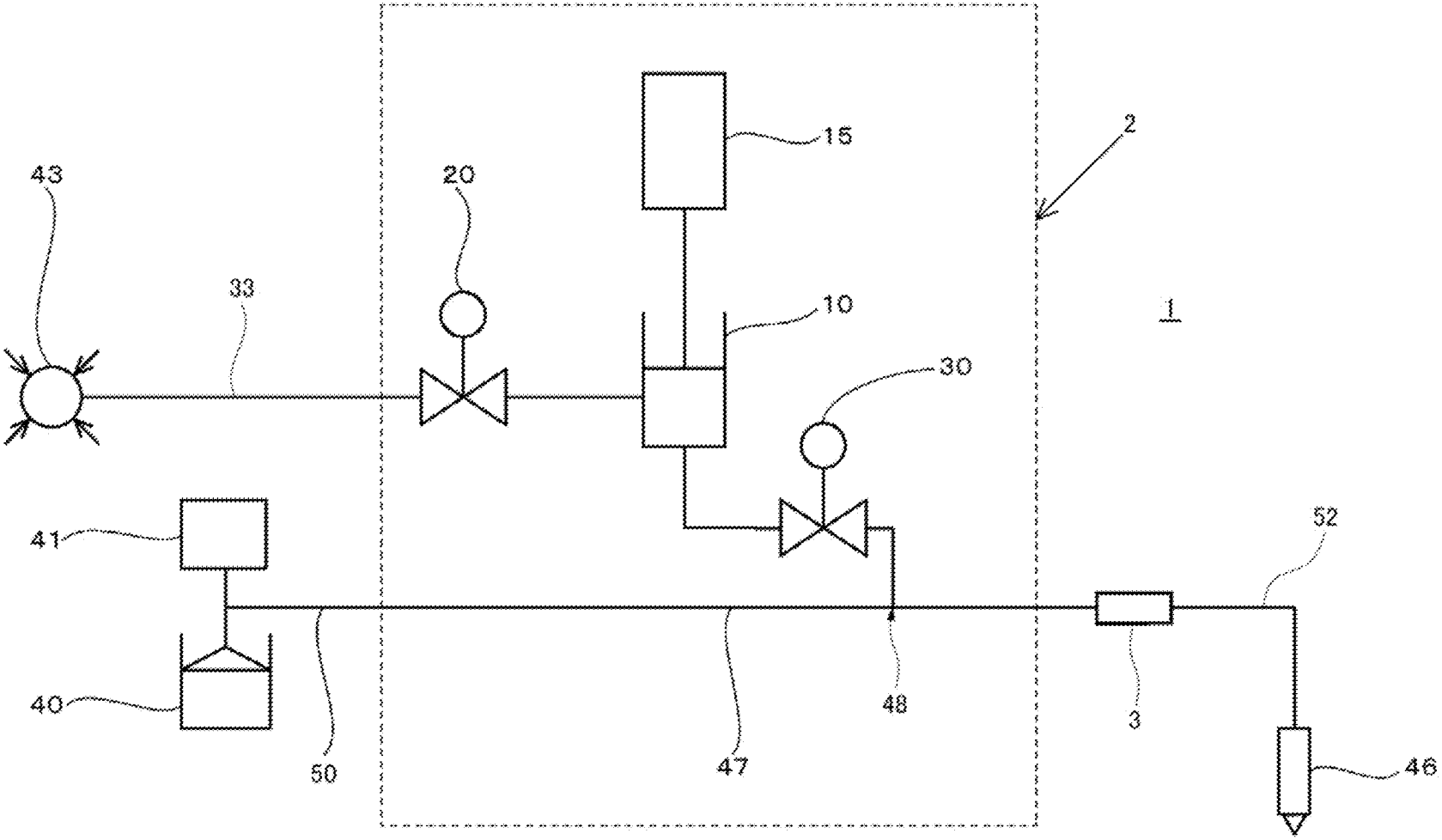
FIG. 1 is a circuit diagram of an apparatus for mixing a paste material with gas according to a first embodiment of the present invention.

FIG. 1 is a circuit diagram for illustrating an apparatus 1 for mixing a paste material with gas according to one embodiment of the present invention.

As shown in FIG. 1, the apparatus 1 for mixing the paste material with the gas of the embodiment includes: a mixing part 2 that mixes a paste material with gas; and a static mixer 3 that is connected to the mixing part 2 in order to stir a mixture obtained by mixing the paste material with the gas in the mixing part 2.

The mixing part 2 includes at least: a piston pump 10 for discharging the gas to a conduit space (it is formed as a passage of the paste material formed by a conduit 47) through which the paste material flows; and a discharge valve 30 that controls gas supply from the piston pump 10 to the conduit 47. A gas discharge pipe extending from the discharge valve 30 is connected to the conduit 47 at a mixing position 48 at which the paste material is mixed with the gas.

Further, the mixing part 2 preferably includes: a drive part 15 that drives the piston pump 10; and a suction valve 20 that controls gas supply to the piston pump 10, and an example also including these configurations is shown in FIG. 1.

The mixing apparatus 1 includes a gas compressor 43 that is connected to the piston pump 10 through a conduit 33 and the suction valve 20 in order to supply the gas to the piston pump 10 of the mixing part 2. The mixing apparatus 1 further includes: a tank 40 that stores the paste material; a pressure pump 41 that pumps the paste material stored in the tank 40; and a conduit 50 through which the paste material pumped from the pressure pump 41 is guided to the conduit 47 in order to supply the paste material to the mixing part 2.

The mixing apparatus 1 further includes: a conduit 52 through which the paste material into which the gas has been mixed flows, the paste material being sent from the conduit 47; and a nozzle 46 attached at a tip of the conduit 52 in order to discharge the paste material into which the gas has been mixed, the paste material being sent from the conduit 52. The static mixer 3 is connected between the conduit 47 and the conduit 52, the mixture obtained by mixing the paste material with the gas in the mixing part 2 flows through the conduit 47, passes through the static mixer 3, and flows through the conduit 52 to reach the nozzle 46. At least any of a length of the conduit from the joining position 48 to the static mixer 3 and the conduit 52 is set in a predetermined length, and thereby the effect of finely dispersing the bubbles of the gas can be improved.

The conduits 50, 47, and 52 may be configured as different conduits, and they may be connected to each other using welding, flanges, etc. so that the paste material flows in these conduits in the above-described order. Naturally, the conduits 50, 47, and 52 may be configured as an integrated conduit from the beginning, and in this case, the static mixer 3 is integrally connected between the conduit 47 and the conduit 52.

Although, for example, a well-known pail, drum, etc. may be used as the tank 40, the present invention is not limited to these. In addition, although various materials are considered as the paste material stored in the tank 40 and, for example, polyurethane, modified silicon, epoxy, silicone, acrylics, vulcanized rubber, plastisol such as PVC and acrylics, and a mixture thereof, and further, grease, edible cream, beauty cream, etc. are included, the present invention is not limited to these.

The pressure pump 41 may be anything as long as it can pump the paste material. As the pressure pump 41, although as a piston pump and a plunger pump for the pail or the drum, for example, rotary pumps, such as an air motor type double-action pump etc., and a gear pump and a screw pump in which pulsation at the time of pumping is not generated can also be employed, the present invention is not limited to these. In addition, a constant flow pump may be incorporated in the pressure pump 41 to thereby enable the paste material to be pumped at a constant flow rate.

Depending on viscosity of the paste material, a pressure at which the paste material is pumped is preferably 20 to 300 $kg/cm^2$, and is more preferably 50 to 200 $kg/cm^2$. This is because when the pressure at which the paste material is pumped becomes lower than 50 $kg/cm^2$, bubbles of the paste material might be coarse in the paste material being foamed, and because when it becomes lower than 20 $kg/cm^2$, a tendency for the bubbles to be coarse becomes more remarkable, and sizes of the bubbles might be non-uniform. In addition, this is because when the pressure becomes higher than 200 $kg/cm^2$, facilities cost high in order to secure pressurization performance and pressure-resisting performance of each component part of the apparatus, and because when it becomes higher than 300 $kg/cm^2$, a tendency for the facilities to cost high becomes more remarkable.

A discharge pressure of the paste material is 3 to 20 MPa, is preferably 5 to 12 MPa, and is more preferably 6 to 10 MPa, when a pressure value measured just in front of the nozzle 46 (just before discharge) is used.

In order to measure a flow rate of the pumped paste material, a flowmeter may be provided between the pressure pump 41 and the discharge valve 30 of the piston pump 10. A flowmeter and a constant flow device may be provided between the discharge valve 30 and the nozzle 46.

The gas compressor 43 can be, for example, configured as a compressor that supplies gas having a comparatively low-pressure of 0 to 1 MPa, 0 to 0.5 MPa, etc. As a type of gas, various gases, such as air (air of an atmospheric pressure, low-pressure air, and compressed air), carbon dioxide gas, nitrogen gas, oxygen, argon, and krypton, can be employed. In addition, although the gas compressor 43 can also be used in a case where air in the atmosphere is employed for the gas supplied to the paste material, instead of using it, an air intake port for taking in the air in the atmosphere may be provided, and the air of the atmospheric pressure introduced from the air intake port may be supplied to the piston pump 10. In this case, an air filter that filters the air and removes dust etc. may be provided between the air intake port and the suction valve 20. Further, a configuration including an adjusting valve etc. as a pressure adjusting mechanism that adjusts a gas tank and a gas pressure can be used instead of the gas compressor 43 or the air intake port. In addition, a pressure of the gas can be set to be a pressurized positive pressure higher than the atmospheric pressure or a negative pressure lower than the atmospheric pressure according to manufacturing conditions at that time.

A design in consideration of pressure-resisting safety becomes unnecessary by using the low-pressure gas. For example, it becomes possible to make component parts (a pipe, a valve, etc.) with materials having low strength, or to reduce thicknesses thereof. Further, control of a gas flow rate can be easily performed, and reliability of gas injection and handling safety can be improved. Hereby, reduction in weight and size of the whole gas mixing system can be achieved. Naturally, the present invention includes an aspect of handling a high-pressure gas according to intended use or a situation, and it is not limited to use of the low-pressure gas.

The nozzle 46 is the one for applying to a work piece the paste material into which the gas has been mixed, and can arbitrarily discharge the paste material. The nozzle 46 can be used by an arbitrary method, and may be, for example, either of a handheld nozzle and a nozzle attached to a tip of a manipulator.

As a method for supplying a mixture of the gas and the paste material to the nozzle 46, not to mention a mode that supplies to the nozzle 46 the mixture discharged from the one mixing part 2, two or more mixing parts 2 are arranged, they are parallelly or alternately operated, and thereby a supply amount of the mixture can be increased, or the mixture can be continuously supplied.

Further, a measuring device may be arranged between the mixing part 2 (one mixing part 2, or two or more mixing parts 2 as described above) and the nozzle 46, and the paste material may be quantitatively provided to the nozzle 46 by the measuring device. In addition, two or more measuring cylinders may be arranged, and the paste material into which the gas has been mixed may be continuously provided to the nozzle 46 by alternate operation of the measuring cylinders.

Further, the mixing part 2 may include a not-shown control unit that controls each component of the mixing part 2. The control unit includes a CPU, a memory, or a relay, a timer, etc., is connected to the drive part 15, the suction valve 20, the discharge valve 30, the pressure pump 41, the flowmeter, the nozzle 46, etc., and makes operate the apparatus 1 for mixing the paste material with the gas in cooperation with the above-described components. For example, the control unit performs control of driving the piston pump 10 by one cycle, etc. whenever a predetermined amount of the paste material flows, based on a signal of the above-described flowmeter that detects a flow rate of the paste material.

In the paste material into which the gas is mixed by the piston pump 10, and that flows through the conduits 47 and 52 to reach the nozzle 46, the gas is dispersed and stirred in the paste material while flowing the conduits 47 and 52. In order to increase a dispersion and stirring effect of the gas, the above-described static mixer 3 is provided.

(Static Mixer: First Example of First Aspect)

Next, a first example of a first aspect of the static mixer 3 will be explained with reference to FIGS. 2A and 2B.

Figure 2A:
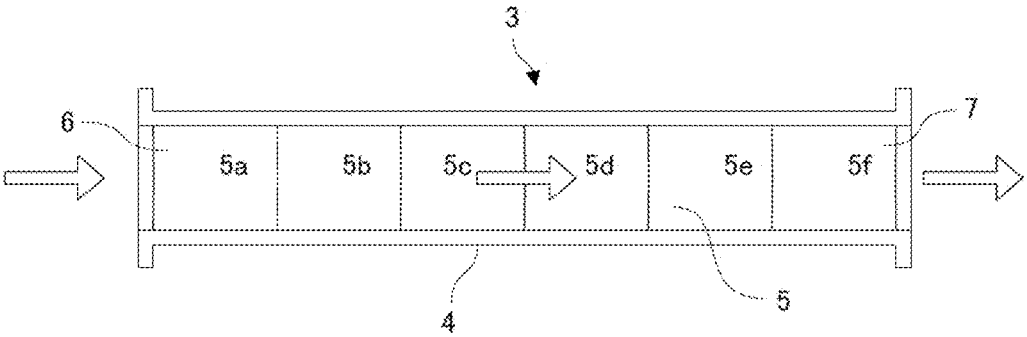
FIG. 2A is a diagram showing a configuration of a first example of a first aspect of a static mixer used in the present invention, and a cross-sectional side view of the static mixer.

As shown in FIG. 2A, the static mixer 3 includes: an outer cylinder 4 having an inlet port 6 and an outlet port 7; and a stirring part 5 that is formed in a cavity in the outer cylinder 4. The inlet port 6 is connected to the conduit 47 of FIG. 1, and the outlet port 7 is connected to the conduit 52 of FIG. 1. The mixture of the paste material and the gas that has flowed through the conduit 47 flows into the static mixer 3 from the inlet port 6, passes through the stirring part 5, and is discharged from the outlet port 7, as shown in arrows in FIG. 2A.

The stirring part 5 is divided into, for example, six stirring sections 5*a*, 5*b*, 5*c*, 5*d*, 5*e*, and 5*f*, and each of the stirring sections has a shape that allows the flow of the mixture passing through the stirring section to be stirred.

Figure 2B:
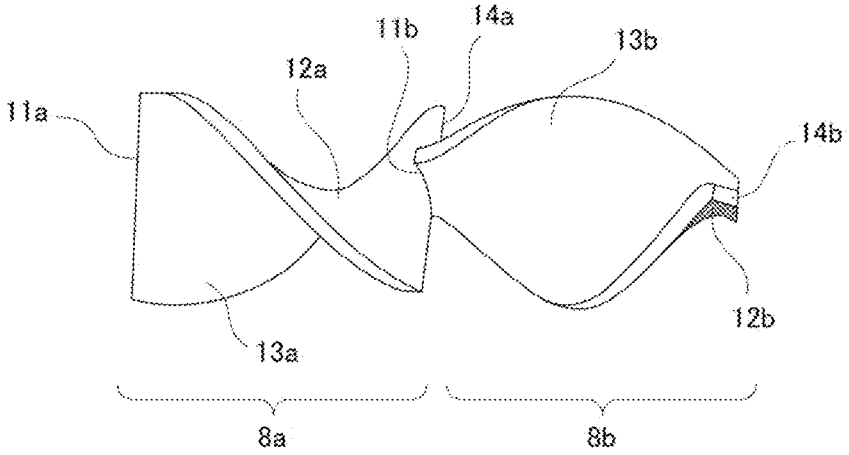
FIG. 2B is a diagram showing a configuration of the first example of the first aspect of the static mixer used in the present invention, and a perspective view of a stirring element formed in a stirring section.

The stirring sections 5*a* to 5*f* may be formed such that static stirring elements 8*a*, 8*b* are alternately arranged as shown in FIG. 2B to improve an stirring efficiency of the mixture. The stirring element 8*a* is twisted by 180 degrees in the left direction to have a helical shape, and includes an inlet edge 11*a*, a first twisted surface 12*a*, a second twisted surface 13*a*, and an outlet edge 14*a*. The stirring element 8*b* is twisted by 180 degrees in the right direction to have a helical shape, and includes an inlet edge 11*b*, a first twisted surface 12*b*, a second twisted surface 13*b*, and an outlet edge 14*b*. The outlet edge 14*a* of the stirring element 8*a* is joined to the inlet edge 11*b* of the stirring element 8*b* such that the outlet edge 14*a* intersects the inlet edge 11*b*. The outlet edge 14*b* of the stirring element 8*b* is joined to an inlet edge of a stirring element formed in the same manner as the stirring element 8*a* such that the outlet edge 14*b* intersects the inlet edge. The stirring elements 8*a*, 8*b* shown in FIG. 2B are thus formed in pair, and a plurality of stirring elements are sequentially joined to one another. One stirring element is arranged in a space of each of the stirring sections 5*a* to 5*f*, or is joined to an inner wall of the space.

The stream of the mixture that has flowed into the stirring section 5*a* of the static mixer 3 is split into two streams by the inlet edge 11*a* of the stirring element 8*a*, and the split streams are diverted from the center to the periphery along the first twisted surface 12*a* and from the periphery to the center along the second twisted surface 13*a*, respectively, to reach the outlet edge 14*a*. The two streams discharged from the outlet edge 14*a* are further split into two streams and are diverted by the stirring element 8*b* twisted in the opposite direction, and the inverting actions of the streams are generated by the surfaces twisted in the different directions. Thus, the stream of the mixture is stirred and mixed while passing through the stirring sections 5*a* to 5*f*.

Further, the first embodiment of the present invention is configured such that a ratio of a volume of the piston pump 10 (output amount) to a volume of at least one of the stirring sections 5*a* to 5*f* of the static mixer 3 is within a range from 1:0.2 to 1:5, and is more preferably within a range from 1:0.5 to 1:3.

A variation of the first embodiment of the present invention is configured such that a ratio of a volume of the mixture per batch that flows through the conduit 47 to the volume of at least one of the stirring sections 5*a* to 5*f* of the static mixer 3 is within a range from 1:0.2 to 1:5, and is more preferably within a range from 1:0.5 to 1:3.

According to the first embodiment, as described above, the ratio of the volume of the piston pump 10 (output amount) to the volume of at least one of the stirring sections of the static mixer is set within the range described above, and thereby the gas can be mixed very efficiently into the paste material.

In the example of FIG. 2A, an example is shown in which the number of stirring sections of the static mixer 3 is six, but the present invention is not limited thereto, and any number of stirring sections including one is possible. In the example of FIG. 2, the stirring sections have the same size (the same inner diameter and the same length), but the present invention is not limited thereto, and the stirring sections can have different sizes to improve the stirring efficiency. For example, the inner diameter of the stirring section can become smaller as it approaches the outlet port 7.

(Static Mixer: Second Example of First Aspect)

In the example of FIG. 2B, an example is shown in which the stirring element has a helical shape, but the first aspect of the static mixer is not limited thereto, and a plurality of baffle plates can be arranged in each of the stirring sections. Such a static mixer will be explained as a second example with reference to FIGS. 8A and 8B.

Figure 8A:
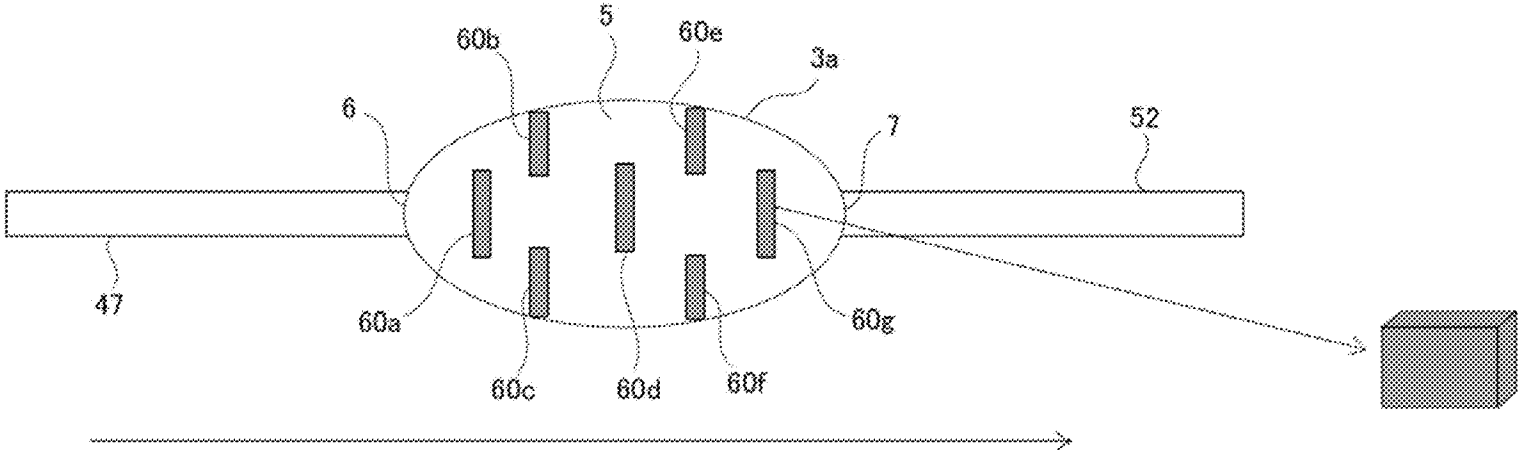
FIG. 8A is a diagram showing a configuration of a second example of a first aspect of a static mixer used in the present invention, and a cross-sectional view of the static mixer having a plurality of baffle plates.
Figure 8B:
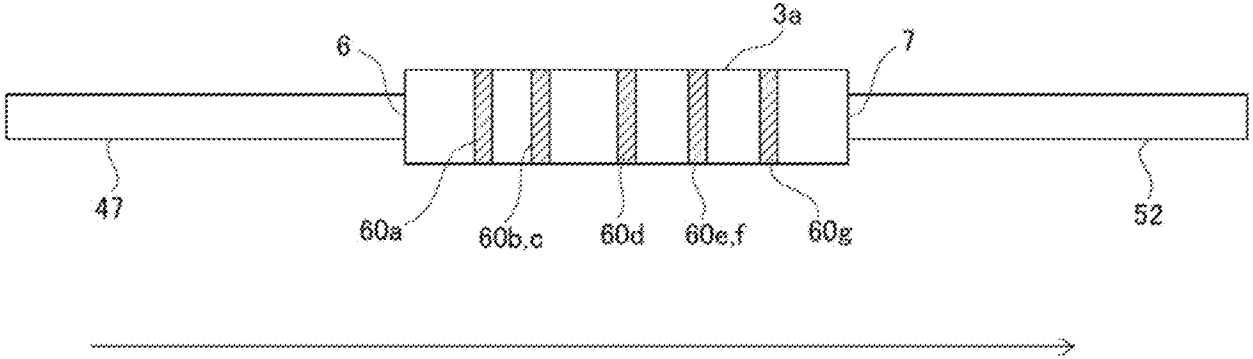
FIG. 8B is a diagram showing a configuration of the second example of the first aspect of the static mixer used in the present invention, and a cross-sectional longitudinal view of the same static mixer as in FIG. 8A.

As shown in FIGS. 8A and 8B, a static mixer 3*a* includes a plurality of baffle plates 60*a*, 60*b*, . . . , and 60*g* that are arranged in the stirring part 5 through which the stream of the mixture passes. As can be better appreciated from a cross-sectional view of FIG. 8A, the baffle plates 60 are alternately arranged against the stream of the mixture. Each of the baffle plates 60*a* to 60*g* has a rectangular-parallelepiped shape as shown in FIG. 8A. As can be better appreciated from a longitudinal sectional view of FIG. 8B, each of the baffle plates 60 extends from a top surface to a bottom surface of the inner wall of the mixer.

In the static mixer 3*a*, a flow of the mixture that has flowed from the inlet port 6 is turned and split when impinging on the first baffle plate 60*a*. Then, the flow impinges on the baffle plates 60*b*, 60*c*, and is further split, but one split stream toward the inner wall is inverted by the inner wall, and then is mixed together with the other split stream into the mixture around the rear side of the baffle plate 60*a*. The mixture thus mixed again passes between the baffle plates 60*b*, 60*c*. Next, the flow of the mixture is turned and split by the baffle plate 60*d*, the split streams impinge on the baffle plates 60*e*, 60*f* and turned, respectively, and the mixture thus mixed again passes between the baffle plates 60*e*, 60*f*. Finally, the flow of the mixture is turned and split by the baffle plate 60*g*, is inversed by the inner wall, and is mixed again before the outlet port 7 to flow out of the static mixer 3*a*. Thus, in the static mixer 3*a*, each action of splitting, turning and inverting of the mixture is repeated to shear the bubbles in the paste material.

As shown in FIG. 8B, a section from the inlet port 6 to the baffle plate 60*a* corresponds to the stirring section 5*a*, a section from the baffle plate 60*a* to the baffle plates 60*b*, 60*c* corresponds to the stirring section 5*b*, similarly, two baffle plates adjacent in the lengthwise direction correspond to subsequent stirring sections, and finally, a section from the baffle plate 60*g* to the outlet port 7 corresponds to the stirring section 5*f*.

The second example of the first aspect is also configured such that a ratio of a volume of the piston pump 10 (output amount) to a volume of at least one of the stirring sections 5*a* to 5*f* of the static mixer 3*a* is within a range from 1:0.2 to 1:5, and is more preferably within a range from 1:0.5 to 1:3.

A further variation may be configured such that a ratio of a volume of the mixture per batch that flows through the conduit 47 to the volume of at least one of the stirring sections 5*a* to 5*f* of the static mixer 3*a* is within a range from 1:0.2 to 1:5, and is more preferably within a range from 1:0.5 to 1:3.

(Static Mixer: Second Aspect)

In the first aspect of the static mixer, an example is shown in which the flow of the mixture sequentially passes through the stirring sections that are arranged in series, but the stirring action can be provided also by splitting the flow of the mixture into parallel streams. This will be explained as a second aspect of the static mixer with reference to FIG. 9.

Figure 9:
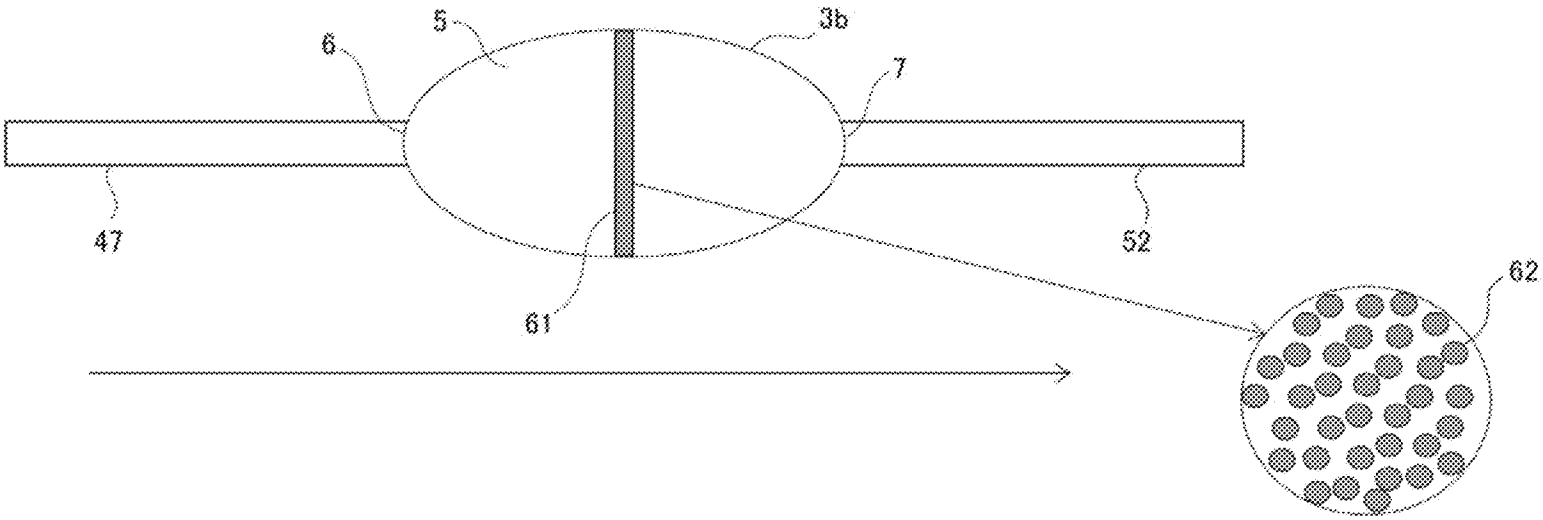
FIG. 9 is a cross-sectional view of a second aspect of a static mixer used in the present invention.

As shown in FIG. 9, a static mixer 3*b* includes one baffle plate 61 that is arranged in the stirring part 5 against the flow of the mixture. A plurality of through-holes 62 through which the flow of the mixture passes are formed in the baffle plate 61. The number of through-holes 62 formed is five or more, and is preferably 10 or more. That is, the flow of the mixture that has reached the baffle plate 61 is split into five or more streams. Note that a peripheral end of one baffle plate 61 is joined to the inner wall of the mixer along the entire circumference of the inner wall.

The flow of the mixture that has passed through the static mixer 3*b* is changed by the baffle plate, and is split into five or more streams by the five or more through-holes that are arranged in parallel. The gas is efficiently stirred in the paste material by the shear force generated at this time, which can make it possible to promote mixing of the paste material with the gas.

The above explanation has been made here with regard to an example of one baffle plate 61, but the second aspect of the static mixer of the present invention is not limited thereto as long as five or more flow paths are provided and each of the flow paths is arranged in parallel to the flow of the mixture. For example, the interior of the static mixer 3*b* may be formed in a honeycomb shape, or a plurality of pipes may be arranged in parallel inside the mixer.

In the second aspect, the stirring part 5 of the static mixer 3*b* through which the flow of the mixture can pass can be understood as one stirring section.

Accordingly, the second aspect is configured such that a ratio of a volume of the piston pump 10 (output amount) to a volume of the stirring section of the static mixer 3*b* is within a range from 1:0.2 to 1:5, and is more preferably within a range from 1:0.5 to 1:3.

A further variation may be configured such that a ratio of a volume of the mixture per batch that flows through the conduit 47 to the volume of the stirring section 5 of the static mixer 3*b* is within a range from 1:0.2 to 1:5, and is more preferably within a range from 1:0.5 to 1:3.

Note that in the second aspect, the inner diameter of the stirring part 5 of the static mixer is enlarged as the mixture flows from the inlet port 6 in an axial direction of the stirring part 5, to reach the maximum inner diameter at a center of the static mixer, and thereafter reduced until the flow of the mixture reaches the outlet port 7. Of course, the stirring part 5 of the static mixer of the second aspect may have the same inner diameter from the inlet port 6 to the outlet port 7, or the inner diameter of the stirring part 5 may change along the axial direction in a manner different from the examples shown in FIGS. 8A and 8B (for example, the inner diameter is increased or reduced from the inlet port 6 to the outlet port 7).

The above-described aspects show examples of a static mixer, but the static mixer used in the present invention is not limited to the above-described examples, and can be arbitrarily and suitably changed. The plurality of static mixers 3, 3*a*, 3*b* can be used by being connected to one another, or different types of static mixers can be used in combination (for example, in combination with the first aspect or the second aspect).

(Configuration of Piston Pump)

Next, a detailed configuration of the piston pump 10 will be explained using FIG. 3.

Figure 3:
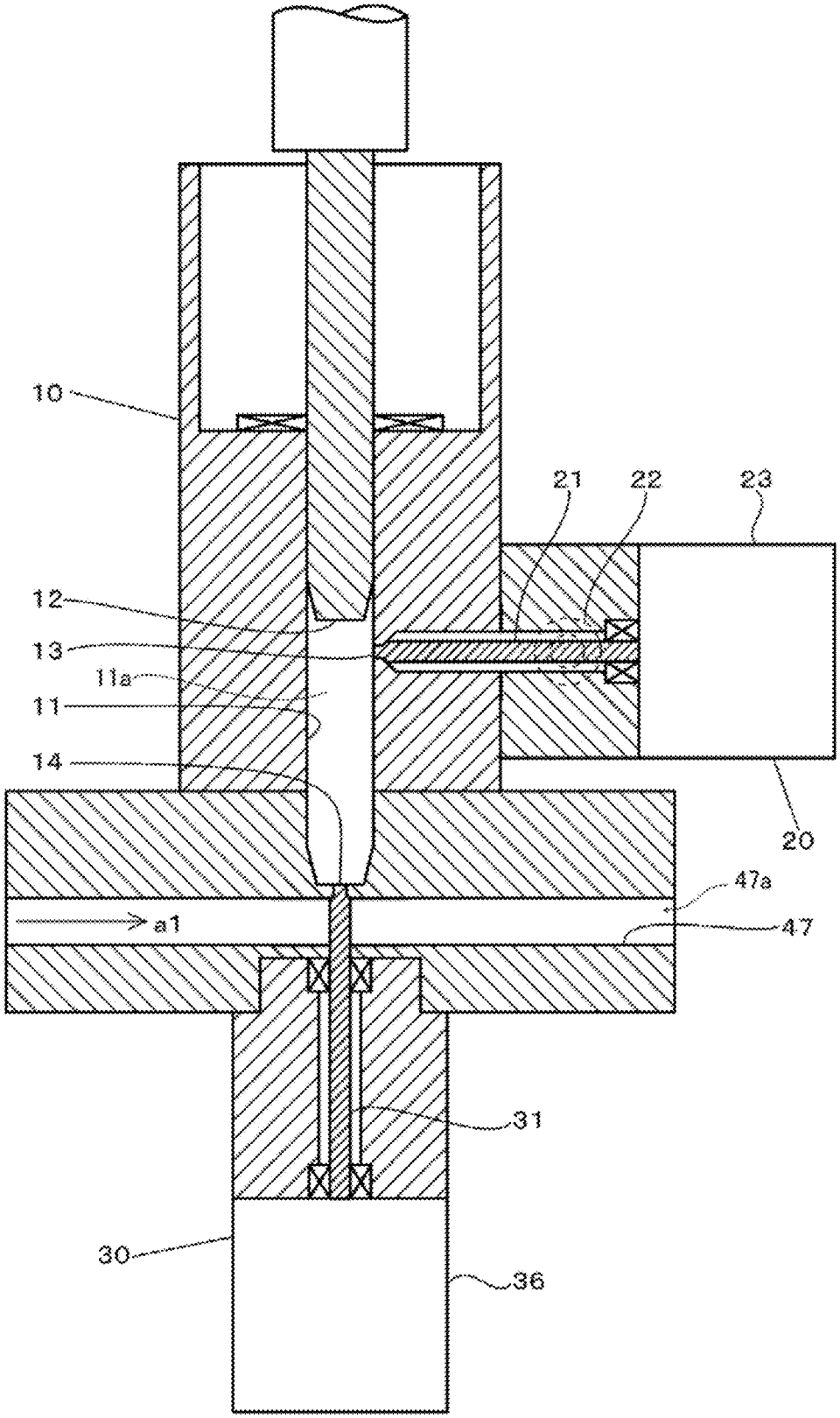
FIG. 3 is a cross-sectional view of the gas mixing apparatus according to the first embodiment (a state where a piston is raised to a first position)

As shown in FIG. 3, the piston pump 10 includes: a cylinder 11; a piston 12 configured to be slidable between a first position (for example, a top dead center) and a second position (for example, a bottom dead center) by the drive part 15 along an axial direction of the cylinder 11 in internal space of the cylinder 11; a suction port 13 for the gas provided in a side wall of the cylinder 11; and a discharge port 14 for the gas. The internal space of the cylinder 11 extends even to an inside of an outer peripheral portion of the conduit 47, and the discharge port 14 is formed near a passage of the paste material that is a termination of the internal space. The cylinder 11 forms a cylinder space having a predetermined volume defined by the piston 12, when the piston 12 is located at the first position (the top dead center).

In the piston 12, a tip of the piston 12 and an inside of an end of the cylinder 11 in which the discharge port 14 has been formed preferably fit to each other without a gap in an operation termination of a compression stroke of the piston 12 (the second position (the bottom dead center) of the piston 12). Here, "fitting without the gap" means that since the tip of the piston 12 has a shape complementary to the inside of the end of the cylinder 11 in which the discharge port 14 has been formed, the tip of the piston 12 can almost completely fit to the inside of the end of the cylinder 11 when the piston 12 is located at the second position (the bottom dead center). Hereby, dead space is eliminated in the cylinder, and a gas amount can be controlled more accurately. Alternatively, "fitting without the gap" also includes a way of fitting in which the "gap" is actually zero. For example, "fitting without the gap" means that when the tip of the piston 12 has the shape complementary to the inside of the end of the cylinder 11 in which the discharge port 14 has been formed, and the piston 12 is located at the second position (the bottom dead center), a distance between the tip of the piston 12 and the inside of the end of the cylinder 11 is 0 or is extremely small, and is not more than 2 mm, is preferably not more than 1 mm, and is more preferably not more than 0.5 mm.

The suction port 13 is provided in the side wall of the cylinder 11 of the piston pump 10. Preferably, the suction port 13 may just be provided near an operation termination of a suction stroke of the piston 12. When the piston 12 is located at the operation termination (the first position (for example, the top dead center)) of the suction stroke or near it, the suction port 13 is opened by the above-described suction valve 20, and the gas is introduced into the internal space of the cylinder 11 from the suction port 13. When the piston 12 starts the compression stroke, and reaches the vicinity of the operation termination (the bottom dead center), the discharge port 14 is opened by the above-described discharge valve 30, and the compressed gas is mixed into the paste material in the conduit 47 through the discharge port 14. Note that although the conduit 47 is formed integrally with component parts of the piston pump 10 near the piston pump 10, a well-known pipe, pressure hose, etc. are employed for portions connected to the other components, such as front and rear of the piston pump 10.

The suction valve 20 is provided on the side wall of the cylinder 11 of the piston pump 10 as shown also in FIG. 3, and opens and closes the suction port 13 of the piston pump 10. In the apparatus 1 for mixing the paste material and the gas of the embodiment, a needle valve is employed for the suction valve 20 as one example. The needle valve 20 includes: a needle shaft 21; a gas introduction port 22; and a drive part 23. The needle shaft 21 is preferably extends along a direction perpendicular to a shaft of the cylinder 11, and slides along the direction. The gas introduction port 22 is the one for introducing into the needle valve 20 the gas supplied from the gas compressor 43, and may be provided in a side surface of a housing of the needle valve 20.

The drive part 23 advances or retracts the needle shaft 21 along a longitudinal direction thereof. The needle shaft 21 can advance (move to a left side in FIG. 2) until a tip thereof fits in and closes the suction port 13. When the needle shaft 21 retracts (moves to a right side in FIG. 2) from a position where the needle shaft 21 fits in the suction port 13, the suction port 13 is opened, and the cylinder 11 and the gas introduction port 22 communicate with each other. Although a well-known air cylinder and electric motor can be used as the drive part 23, the present invention is not limited to this. In addition, a valve guide 21*a* for guiding the needle shaft 21 may be provided at a tip of the needle valve 20 of a suction port 13 side.

The discharge valve 30 is provided at the tip of the cylinder 11 of the piston pump 10, and opens and closes the discharge port 14 of the piston pump 10. In the apparatus 1 for mixing the paste material and the gas of the embodiment, a needle valve is employed for the discharge valve 30 as one example. The needle valve 30 is provided at a position opposed to the discharge port 14 of the piston pump 10 across a conduit space 47*a* formed by the conduit 47, and includes a needle shaft 31 and a drive part 36. The needle shaft 31 is provided coaxially with the shaft of the cylinder 11 so that a tip thereof passes through the conduit space 47*a* to fit in the discharge port 14.

The drive part 36 advances and retracts the needle shaft 31. The needle shaft 31 can advance (move to an upper side in FIG. 2) until the tip thereof fits in and closes the discharge port 14. At this time, when the needle shaft 31 retracts (moves to a lower side in FIG. 2) from a position where the needle shaft 31 fits in the discharge port 14, the discharge port 14 is opened, and the cylinder 11 and the conduit 47 communicate with each other. Although a well-known air cylinder and electric motor can be used as the drive part 36, the present invention is not limited to this. In addition, in the needle valve 30, a valve guide for guiding the needle shaft 31 may be provided in the conduit 47. Such a valve guide may be configured to include: a cylindrical body; a vertical hole through which the needle shaft 31 is made to vertically movably penetrate; and a horizontal hole that communicates with the conduit space 47*a*, and inside which the paste material is transferred.

Note that although the tips of the needle shafts 21 and 31 are schematically represented in FIG. 2, they can be formed as various shapes, such as a conical shape, a truncated cone, and a hemispherical shape in order to improve airtightness. In addition, the suction valve and the discharge valve are not limited to needle valves, and a valve having an arbitrary configuration can be used as long as it can open and close the suction port 13 and the discharge port 14. For example, a piston valve whose piston does not have a needle shape, a check valve, or a mechanism that opens and closes the suction port can also be employed.

(Operations of First Embodiment)

Figure 4:
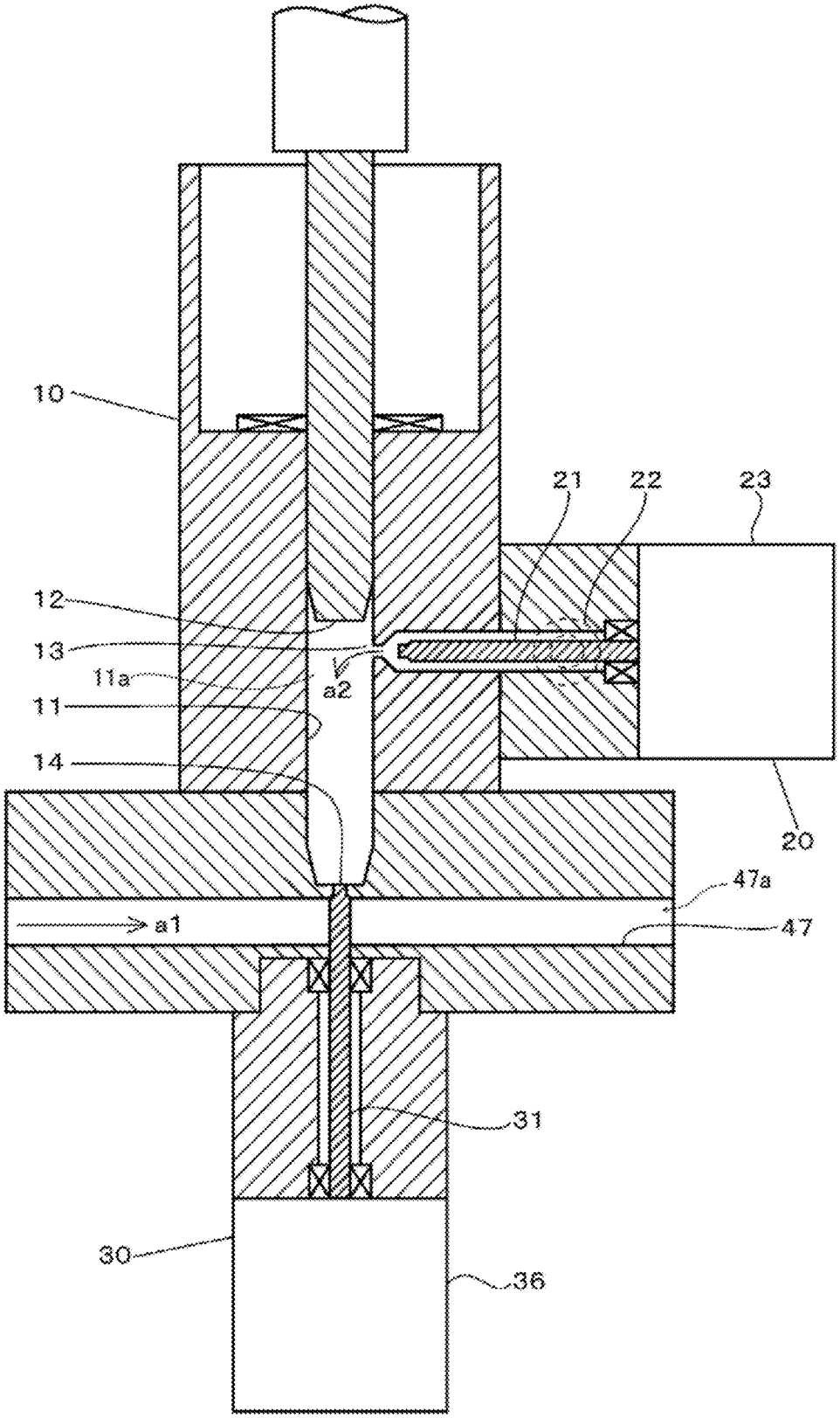
FIG. 4 is a cross-sectional view of the gas mixing apparatus according to the first embodiment (a state where a suction valve is opened in the gas mixing apparatus of FIG. 3), and illustrates a step of making a piston pump suction gas.
Figure 5:
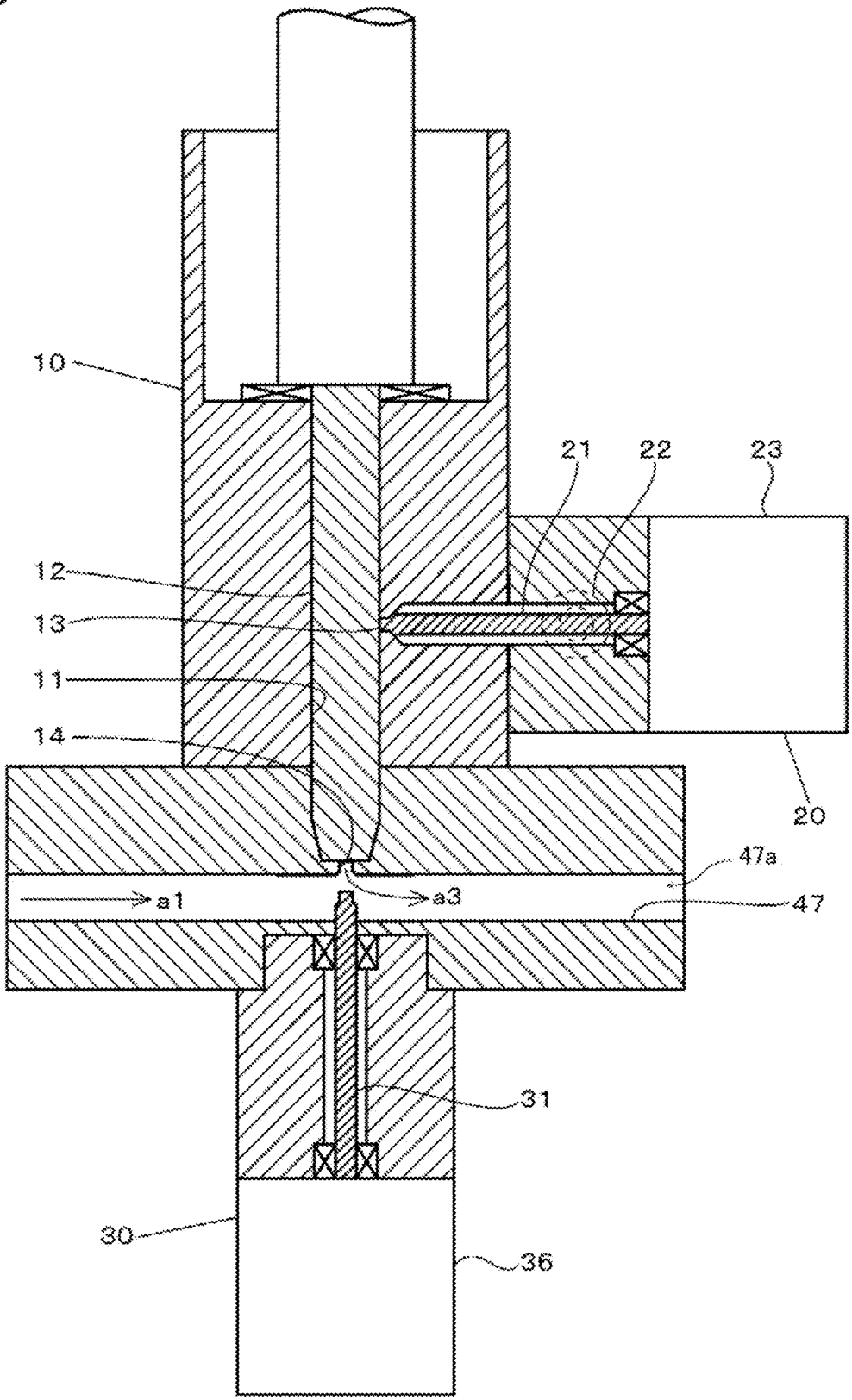
FIG. 5 is a cross-sectional view of the gas mixing apparatus according to the first embodiment (a state where the suction valve is closed, the piston is lowered to a second position, and where a discharge valve is opened in the gas mixing apparatus of FIG. 3), and illustrates a step of mixing compressed gas generated by the piston pump into a paste material.

Next, operation of the apparatus 1 for mixing the paste material with the gas of the embodiment will be explained with reference to FIGS. 1 to 5 on the basis of a function of each component as explained above. FIGS. 1 and 3 are as already explained. FIG. 4 is a view illustrating a step of making the piston pump 10 suction gas, and FIG. 5 is a view illustrating a step of mixing the compressed gas generated by the piston pump 10 into the paste material.

First, the paste material is pumped from the tank 40 containing the paste material to a downstream side by the pressure pump 41 through the conduit 47. Note that in FIGS. 3 to 4, the paste material is assumed to be transferred from left toward right in the conduit 47 as shown in an arrow a1.

Note that, for example, one of the following methods is employed in the embodiment in order to monitor and determine whether or not a predetermined amount of the paste material has been transferred.

(1) The piston pump 10 is actuated interlocking with the pressure pump 41 including a quantification device.

(2) Suction of the pressure pump 41 whose capacity of one stroke is well-known (the capacity is decided) is counted, and the piston pump 10 is actuated.

(3) The piston pump 10 is actuated interlocking with a constant flow device and a discharge gun with constant flow installed separately from the pressure pump 41 and the piston pump 10 (change of a gas capacity of the cylinder is carried out by change and adjustment of a pressure of the gas, or a stroke of the piston).

(4) The piston pump 10 is actuated according to usage using a booster pump and a cylinder drive type discharge gun installed separately from the pressure pump 41 and the piston pump 10.

(5) Timing at which a predetermined amount of the paste material is transferred is determined based on a measured value of the flowmeter, and the piston pump 10 is actuated in accordance with the timing.

The mixing part 2 is controlled so that one cycle of the piston pump 10 is executed whenever the predetermined amount of the paste material (the arrow a1 in FIGS. 2 to 4) flows. Note that the correspondence between the timing at which the predetermined amount of the paste material flows and time point of each operation of the piston pump 10 can be arbitrarily suitably changed, as long as one cycle of the piston pump 10 and a flow rate of the paste material can maintain a fixed relation. Hereinafter, one cycle of the piston pump 10 will be explained.

As shown in FIG. 3, the piston 12 moves to the operation termination of the suction stroke, i.e. from the second position to the first position, in a state where the suction valve 20 and the discharge valve 30 connected to the piston pump 10 are closed. At this time, although a cylinder space having a predetermined volume is formed in the cylinder 11, an inside of the cylinder 11 is a vacuum since the suction valve 20 and the discharge valve 30 are closed.

Next, the needle shaft 21 is retracted (moves to a right side in FIG. 3) by the drive part 23 of the suction valve 20 as shown in FIG. 4. The suction port 13 is then opened, the cylinder 11 and the gas introduction port 22 communicate with each other, and the gas before compression flows into the cylinder space having the predetermined volume in the cylinder 11 (an arrow a2 in FIG. 3). Subsequently, when the needle shaft 21 is advanced (moves to a left side in FIG. 3), and the suction valve 20 is closed, the inside of the cylinder 11 is filled with the gas, and the cylinder 11 becomes a state of being sealed. Namely, the suction valve 20 is opened for a predetermined time, and is closed at the time when a predetermined amount of the gas is stored in the cylinder 11. Next, operation of the piston 12 is stopped until the predetermined amount of the paste material flows.

Next, the piston 12 is moved to a compression stroke side, and the gas with which the cylinder 11 is filled is compressed. Namely, the piston is lowered from the first position to the second position. When the piston 12 reaches the vicinity of the operation termination (the bottom dead center) of the compression stroke, the discharge valve 30 is opened. Namely, the needle shaft 31 is retracted (moves to a lower side in FIG. 4) by the drive part 36 of the discharge valve 30, and the discharge port 14 is opened. As shown in FIG. 5, the compressed gas is then mixed into the paste material pumped in the conduit 47, and the piston 12 reaches the operation termination (the bottom dead center) of the compression stroke. Next, when the needle shaft 31 is advanced (moves to an upper side in FIG. 4), and the discharge valve 30 is closed, one cycle of mixing of the gas into the paste material is ended.

Note that the above-described vicinity of the operation termination of the piston 12 is preferably a piston position where the gas is compressed to 1/5 to 1/100, and is preferably a piston position where the gas is compressed to 1/10 to 1/30. At this time, in a case where a pressure of the material is higher than a pressure of the gas, the material flows backward from the discharge port 14 into the cylinder, the material is mixed with the gas in a gas cylinder. If the pressure of the material is much larger than the gas pressure, the material may change in quality by a shear force brought about by the discharge port 14 having a comparatively small diameter and an inflow velocity of the material. In addition, in a case where the gas pressure is much larger than the material pressure, the material does not flow into the cylinder, and thus mixability of the gas and the material may be deteriorated. Accordingly, mixability can be enhanced in a range where the material is not prevented from changing in quality by properly adjusting the gas pressure and the material pressure.

Subsequently, when the predetermined amount of the paste material is transferred again, the above-described operation is repeated. Note that since the paste material pumped in the conduit 47 has a high pressure as already mentioned, mixed air is also compressed according to the pressure, and volume thereof is reduced. For this reason, even though the air is mixed into the paste material, it hardly affects the flow rate of the paste material, and pulsation etc. does not occur, either.

Next, the paste material into which the gas has been mixed is stirred while flowing through the conduits 47 and 52, hereby, bubbles of the mixed gas are made fine, and the fine bubbles are dispersed in the paste material. The paste material in which the fine bubbles have been dispersed is discharged from the nozzle 46, and is applied to a work piece etc. When the paste material is discharged from the nozzle 46, the paste material having the high pressure till then is located under an atmospheric pressure environment. In that case, the bubbles of the gas mixed into the paste material expand, and the paste material is foamed with a foam ratio according to an amount of the mixed gas. Note that a mixer may be used as needed in order to promote dispersion of the bubbles into the paste material.

As explained above, according to the apparatus for mixing the paste material and the gas, and the method for the same using the apparatus for mixing the paste material and the gas of the embodiment, since the piston pump is made to operate for each predetermined flow rate of the paste material, a ratio of mixing the gas into the paste material, i.e. the foam ratio of the paste material, can be freely changed by changing operation timing of the piston pump. For example, assuming that volume of the cylinder space 11*a* is 50 ml, and that the gas introduced into the cylinder 11 has the atmospheric pressure, if the piston pump is made to operate by one cycle whenever 50 ml of the paste material is transferred, the foam ratio becomes approximately twice. Similarly, if the piston pump is made to operate by one cycle whenever 100 ml of the paste material is transferred, the foam ratio becomes approximately one and a half times, and if the piston pump is made to operate by one cycle whenever 25 ml of the paste material is transferred, the foam ratio becomes approximately three times. It is needless to say that the above-described foam ratio can be changed also by changing the pressure of the gas introduced into the cylinder 11, or changing the volume of the cylinder space 11*a*. In order to change the volume of the cylinder space 11*a*, for example, operation of the piston 12 can be changed so as to change the first position of the piston 12.

Namely, in the example of the present invention, there is any one of next means, or a combination of the two or more means, as means for changing the foam ratio.

(1) Change of supply amount of paste material per one cycle of piston pump (Either speed of one cycle of piston pump or supply amount of paste material is changed, or both of them are changed)

(2) Change of pressure of gas introduced into cylinder space 11*a*

(3) Change of volume of cylinder space 11*a* (for example, change of first position of piston 12)

Particularly, in a conventional method for putting gas and a paste material in one piston pump together and then compressing them, when a foam ratio is tried to make lower than twice, it is necessary to make the gas with which an inside of the piston pump is filled have a negative pressure lower than the atmospheric pressure, and a configuration of the piston pump has been complicated since a negative-pressure tank etc. are added. In addition, when the foam ratio is tried to make higher than twice, it is necessary to increase the pressure of the gas with which the piston pump is previously filled, and a pressure tank etc. are needed similarly to the above. Additionally, when the pressure of the gas becomes high, the inside of the piston pump cannot be filled later with a prescribed amount of the paste material, and an error of the foam ratio occurs. Meanwhile, in the apparatus for mixing the paste material and the gas of the embodiment, only by increasing or decreasing the number of operations of the piston pump, not only the foam ratio can be easily changed, but the negative-pressure tank, the pressure tank, etc. become unnecessary, and thus, a configuration of the apparatus can be made simple.

Similarly, in the conventional method for putting the gas and the paste material in one piston pump together and then compressing them, a port from which the paste material is supplied or discharged cannot be made large in order not to increase dead space of the piston pump, a shear force is applied to the paste material at the time of passing through the port depending on a type of the paste material, and thus the paste material might change in quality. Meanwhile, in the apparatus for mixing the paste material and the gas of the embodiment, it is possible to previously compress the gas in the cylinder 11, and to reduce a pressure difference between the paste material and the gas. In that case, backflow of the paste material into the cylinder can be reduced, and there is nothing to worry about change in quality of the paste material. Note that as mentioned above, prevention of backflow of the paste material by compression of the gas is preferably performed in a range where mixability of the gas and the material is maintained good.

In addition, since the pressure pump that pumps the paste material, and the piston pump that compresses the gas have configurations independent from each other, operation of the piston pump does not affect the transfer of the paste material. Hereby, even with a configuration of including only a set of the pressure pump and the piston pump, and without providing a buffer tank, the paste material into which the gas has been mixed can be continuously sent, and further, sending of the paste material can also be stopped at arbitrary timing.

Similarly, since the pressure pump that pumps the paste material, and the piston pump that compresses the gas have the configurations independent from each other, and a mixing amount of the gas can be controlled only by increasing or decreasing the number of operations of the piston pump, the piston pump having the same volume can be used to some extent even though the flow rate of the paste material and a size of the pressure pump are changed.

In addition, since the paste material is not pumped in a multi-stage as in the conventional method, but is pumped with a predetermined pressure from the beginning, only one pressure pump that pumps the paste material is needed, and the configuration of the apparatus becomes simple.

In addition, in the other embodiment that uses gas other than the air having the atmospheric pressure as the gas mixed into the paste material, and includes a gas tank, an adjusting valve, etc., the foam ratio of the paste material can be changed by adjusting the pressure of the gas before compression supplied to the piston pump even though the operation timing of the piston pump is not changed. For example, in a case where the volume of the cylinder space 11*a* is 50 ml, and a pressure of the gas before compression supplied to the cylinder space 11*a* is 1 atmosphere, if the piston pump is made to operate by one cycle whenever 50 ml of the paste material is transferred, the foam ratio becomes approximately twice. However, the foam ratio becomes approximately three times by setting the pressure of the gas before compression supplied to the piston pump to be 2 atmospheres, and can be made approximately one and a half times by setting it to be 0.5 atmosphere.

Further, both a system that adjusts the gas mixing ratio to the above-mentioned paste material by changing the operation timing of the piston pump for each predetermined flow rate of the paste material, and a system that adjusts the gas mixing ratio to the paste material by adjusting the pressure of the gas before compression supplied to the piston pump are used, whereby a wide range amount of gas can be mixed to the paste material by the piston pump having the same volume, and whereby one piston pump can be made to widely deal with pressure pumps having various capacities.

Second Embodiment

Next, a second embodiment will be explained with reference to FIG. 6. Note that the configuration requirements that are the same as those of the first embodiment are denoted by the same reference numerals, and the detailed explanation will be omitted.

Figure 6:
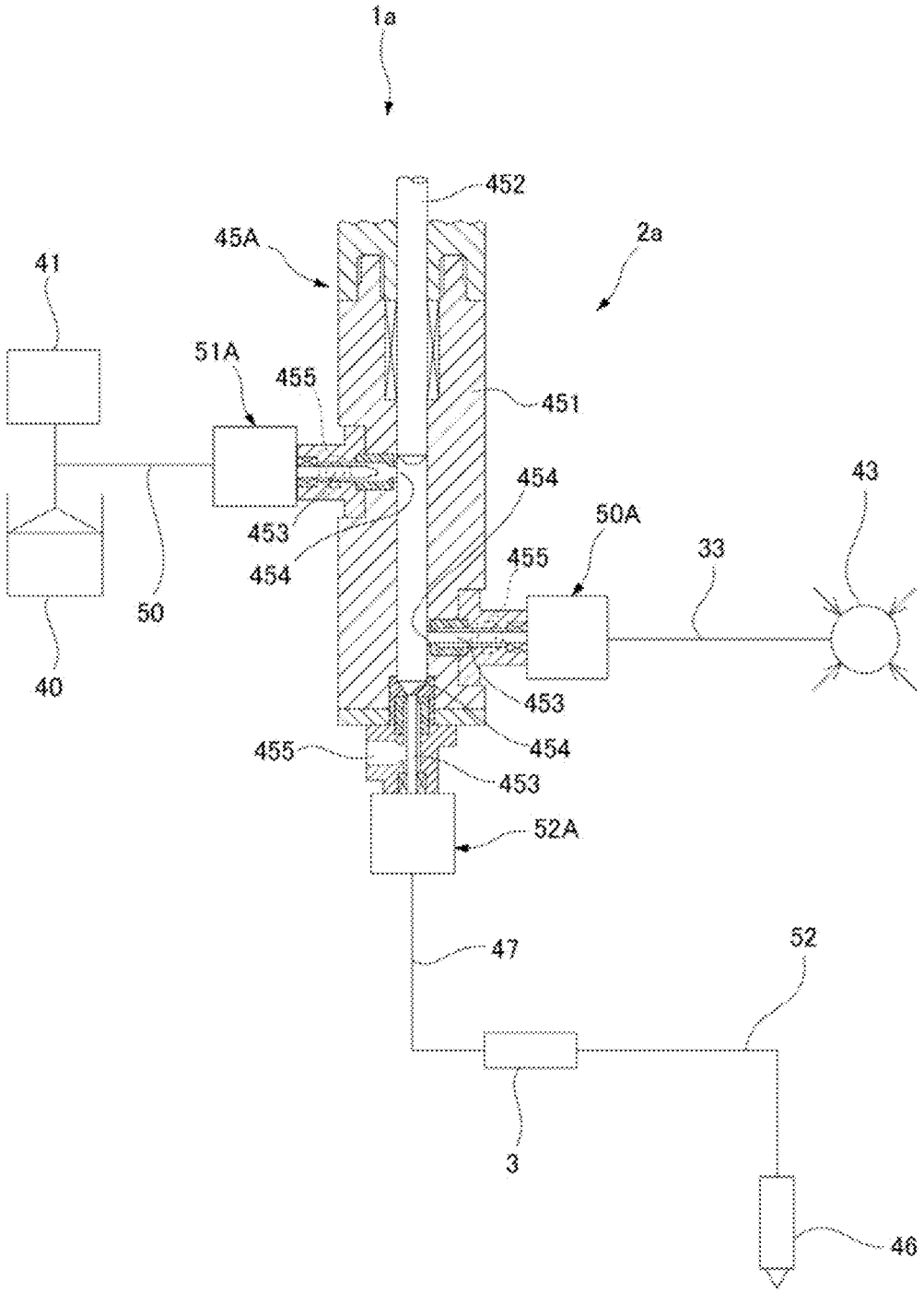
FIG. 6 is a circuit diagram of an apparatus for mixing a paste material with gas according to a second embodiment of the present invention, and a cross-sectional side view of a part of configuration requirements.

As shown in FIG. 6, a mixing part 2*a* of a mixing apparatus 1*a* of the second embodiment includes a piston pump 45A. The piston pump 45A includes a cylinder 451, a piston 452 that sealingly slides in the cylinder 451, and three valves 50A, 51A, 52A that are provided to the cylinder 451. Note that in the embodiment, the valves 50A, 51A, 52A are so-called needle valves.

The needle valve 50A is a valve for controlling gas supply in the cylinder 451, the gas being supplied through a conduit 33, and is provided in the vicinity of the stroke end (near the bottom dead center) of a discharge step. The needle valve 51A is a valve for controlling paste material supply into the cylinder 451, the paste material being supplied through a conduit 50, and is provided in the vicinity of the stroke end (near the top dead center) of a suction step. The needle valve 52A is a valve for controlling discharge of mixture of the paste material and the gas, and is provided at a stroke end of the discharge step in the piston pump 45A. Note that the needle valve 50A for controlling gas supply may be arranged in the vicinity of the stroke end (near the top dead center) of the suction step.

These needle valves 50A, 51A, 52A have substantially the same structure as one another, and the needle 453 is driven by a not-shown pneumatic cylinder and is moved in the axial direction (an air drive system), and a tip of the needle 453 is configured to open and close an opening 454 that is provided in an inner peripheral surface or an end surface of the cylinder 451. A port 455 communicating with the valve chamber of the above-described pneumatic cylinder is provided in a valve body. Note that in addition to the air drive system, a cylinder drive system such as an automobile engine using a cam shaft, etc. can be employed to operate the needle valves.

In a state in which the needle valves 50A, 51A, 52A are closed, the tips of the respective needles 453 are flush with the inner peripheral surface or the end surface of the cylinder 451 so that the dead space between the piston 452 and each of the tips of the needles 453 is substantially zero. Accordingly, when the needle valve 52A is opened and the discharge step is performed without allowing part of the gas or the paste material supplied in the cylinder 451 to enter and be retained in the valve chambers of the respective needle valves 50A, 51A, 52A, etc. in the state in which the needle valves 50A, 51A, 52A are closed, all of the gas and the paste material that are supplied in the cylinder 451 are discharged. The gas and the paste material that have been discharged from the cylinder 451 are discharged from the nozzle 46 through the conduit 47, the static mixer 3, and the conduit 52.

A not-shown control device controls each configuration requirement so that the gas is supplied in the cylinder 451 of the piston pump 45A in the suction step, the paste material is supplied in the cylinder 451 after the suction step, and the discharge step is performed after end of the supply of the paste material to discharge the gas and the paste material to the conduit 47.

The volume of the piston pump 45A (the discharge capacity) is decided by a diameter and a stroke (a travel distance) of the piston 452. In other words, the volume of the piston pump 45A is a volume of the interior of the cylinder 451 defined by the piston that is located at the stroke end in the suction step. In an example of the embodiment, the diameter of the piston 452 is 16 mm, the stroke thereof is 125 mm, and the volume thereof is 25 cc.

The second embodiment of the present invention is configured such that a ratio of a volume of the piston pump 45A (discharge capacity) to a volume of at least one of the stirring sections 5*a* to 5*f* of the static mixer 3 is within a range from 1:0.2 to 1:5, and is more preferably within a range from 1:0.5 to 1:3.

According to the second embodiment, as described above, the ratio of the volume of the piston pump 45A (discharge capacity) to the volume of at least one of the stirring sections of the static mixer is set within the range described above, and thereby the gas can be mixed very efficiently into the paste material.

Third Embodiment

Next, a third embodiment will be explained with reference to FIG. 7. Note that the configuration requirements that are the same as those of the first and second embodiments are denoted by the same reference numerals, and the detailed explanation will be omitted.

Figure 7:
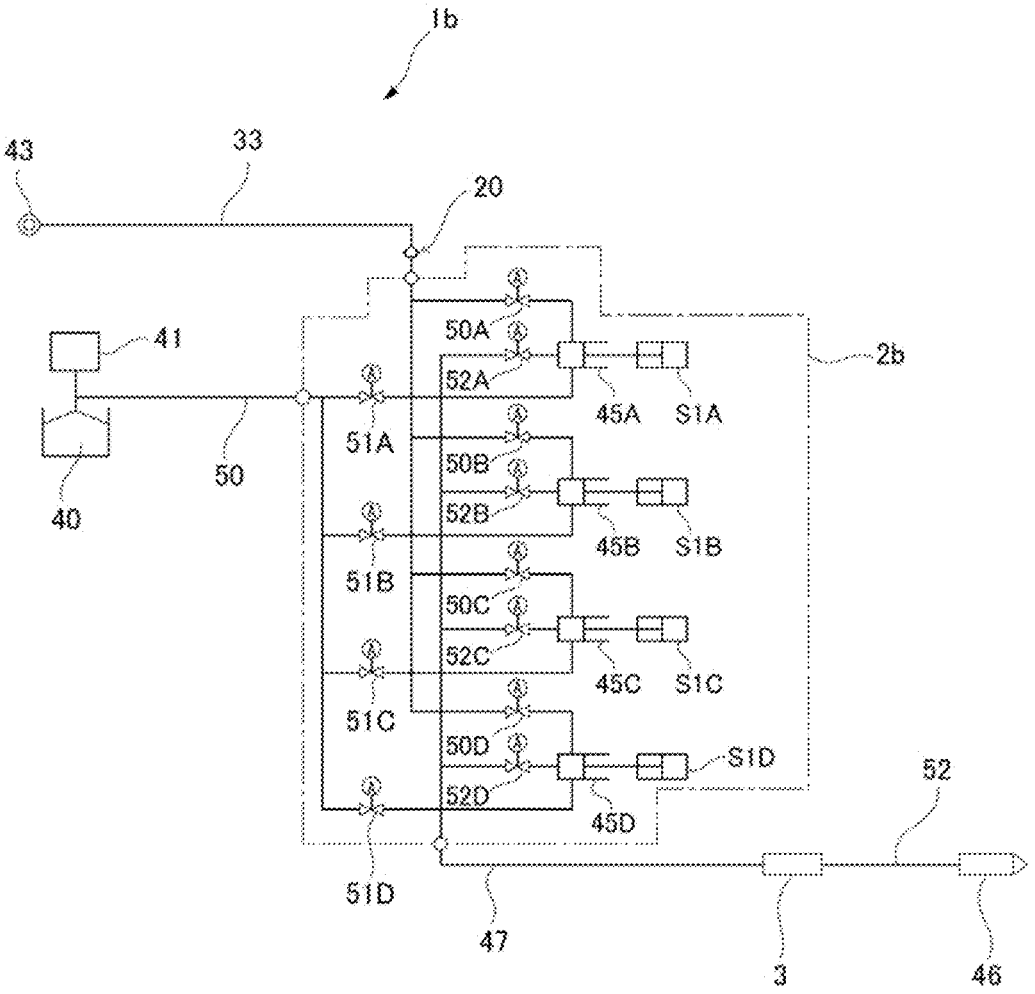
FIG. 7 is a circuit diagram of an apparatus for mixing a paste material with gas according to a third embodiment.

As shown in FIG. 7, a mixing part 2*b* of a mixing apparatus 1*b* of the third embodiment includes four piston pumps 45A, 45B, 45C, 45D. The piston pumps 45B, 45C, 45D are configured in a similar manner as the above-described piston pump 45D according to the second embodiment.

The conduit 33 for supplying the gas branches into four conduits in the mixing part 2*b*, and the four conduits are connected to the piston pumps 45A to 45D through valves 50A to 50D for controlling gas supply, respectively. The conduit 50 for supplying the paste material also branches into four conduits in the mixing part 2*b*, and the four conduits are connected to the piston pumps 45A to 45D through valves 51A to 51D for controlling paste material supply, respectively. Hereby, each of the piston pumps 45A to 45D introduces the paste material pumped from the tank 40 and the gas supplied from the gas compressor 43 in a batchwise manner.

Conduits extend from the not-shown discharge ports of the piston pumps 45A to 45D through the valves 52A to 52D for controlling the discharge, respectively, and these four conduits are combined into a single conduit 47 for discharging the mixture of the paste material and the gas. That is, in the embodiment, the manifold structure can be formed in which the conduits for the material suction, the gas suction, and the mixture discharge are collected to one, and each of these conduits branches to each of the piston pumps. By employing such a manifold structure, reduction in size of the mixing apparatus 1*b* can be achieved, the piping connection can be facilitated, and a mixing and discharging apparatus can be simplified. The piston pumps are provided independent of one another to be replaceable, which allows an easy overhaul, and can achieve both of the size reduction and the maintainability. Further, the mixing apparatus 1*b* is configured such that the piston pump is newly attached to or removed from the piping system of the manifold structure, which allows the number of stages to be easily selected according to the required continuous maximum amount of discharge. The static mixer 3 is connected to the conduit 47.

A not-shown control device controls each configuration requirement so that the gas is supplied in the cylinder 451 of the piston pumps 45A to 45D in the suction step, the paste material is supplied in the cylinder 451 after the suction step, and the discharge step is performed after end of the supply of the paste material to discharge the gas and the paste material to the conduit 47.

The discharge steps of the respective piston pumps 45A to 45D are controlled with time differences so as to allow for the continuous constant amount of discharge. For example, each configuration requirement is controlled so as to start the discharge step of another piston pump around the time point at which the discharge step of any one of the piston pumps is ended.

In order to increase the discharge amount per one cycle, the discharge step of each of the piston pumps 45A to 45D may be controlled so as to overlap in time with one another. For example, each configuration requirement is controlled such that the discharge steps of the piston pumps 45A to 45D are performed simultaneously.

The piston pumps 45A to 45D are divided into two sets each of which consists of two piston pumps, such that the piston pumps of the same set can be controlled simultaneously, and a different set of piston pumps can be controlled with time differences. Note that it is possible to arbitrarily and suitably change how the piston pumps should be grouped.

The third embodiment of the present invention is configured such that a ratio of a total volume of the piston pumps 45A to 45D (the total sum of discharge capacities of four piston pumps) to a volume of at least one of the stirring sections 5*a* to 5*f* of the static mixer 3 is within a range from 1:0.2 to 1:5, and is more preferably within a range from 1:0.5 to 1:3.

According to the third embodiment, as described above, the ratio of the total volume of the piston pumps 45A to 45D to the volume of at least one of the stirring sections of the static mixer is set within the range described above, and thereby the gas can be mixed very efficiently into the paste material.

In the third embodiment, an example is shown in which the number of piston pumps is four, but the embodiment is not limited thereto, and the same configuration can be applied to a case where the number of piston pumps is two, three, or five or more.

Note that the above-mentioned apparatus for mixing the paste material with the gas and method for the same are exemplifications of the present invention, and that configurations thereof can be appropriately changed without departing from the spirit of the invention.

For example, in the mixing part 2 shown in FIG. 3 etc., the conduit 47 is set to be one of configuration requirements, the cylinder space 11*a* extends even an inside of a side wall of the conduit 47, and the discharge port 14 is provided near the conduit space 47*a*. However, if the discharge port 14 can be provided near the conduit space 47*a*, there is no need to form the cylinder space 11*a* even the inside of the side wall of the conduit 47. As such a situation, a case is considered where the discharge port 14 can be arranged extremely near the conduit space 47*a* even if the side wall of the conduit 47 is extremely thin, and the discharge port 14 is provided outside the conduit 47 (only a hole for the discharge port 14 is formed in the conduit 47). In such a case, it becomes possible to eliminate the conduit 47 from the configuration requirements of the mixing part 2 of the present invention. Namely, the mixing part 2 of the present invention can be provided in an aspect in which the conduit 47 (or a part of the conduit) is not present.

In addition, the present invention is not limited to a disclosed positional relation between the cylinder 11 and the conduit 47 (the positional relation in which a longitudinal direction of the cylinder 11 is perpendicular to the conduit 47), and, for example, an aspect is also considered in which the cylinder 11 is arranged obliquely or parallelly to the conduit 47.

In addition, although the needle valves are used as the suction valve 20 and the discharge valve 30 in the above-described example, arbitrary types of valves, for example, gate-type valves etc. can also be used as long as they can open and close the cylinder space and the conduit space.

The operation timing is not limited to the disclosed example, either, and it becomes possible to make each configuration requirement operate at arbitrary timing as long as gas having predetermined volume and a predetermined pressure can be mixed into a predetermined amount of paste material.

Further, although in the above-described example, the suction valve 20 is used as the configuration requirement to open and close the suction port 13 of the mixing part 2, the suction valve 20 can also be omitted as long as the cylinder space 11*a* can be filled with the gas in the present invention. For example, an aspect is also considered in which gas having a predetermined pressure is introduced from not-shown gas supply means into the cylinder space 11*a* without a valve through the suction port.

Further, although in the above-described example, the method for mixing the paste material with the gas of the present invention is executed by the mixing apparatus 1 including the mixing part 2 disclosed as the example of the present invention, the method of the present invention is not limited to the example using the disclosed mixing apparatus 1. For example, means for opening and closing the suction port 13 and the discharge port 14 can be an opening and closing configuration other than the disclosed suction valve 20 and discharge valve 30. In addition, the positional relation between the cylinder 11 and the conduit 47 can also be arbitrarily and suitably changed as mentioned above.

REFERENCE SIGNS LIST

1, 1*a*, 1*b* Apparatus for mixing paste material with gas
2, 2*a*, 2*b* Mixing part
3, 3*a*, 3*b* Static mixer
5 Stirring part
5*a*, 5*b*, 5*c*, 5*d*, 5*e*, 5*f* Stirring section
6 Inlet port
7 Outlet port
8*a*, 8*b* Stirring element having helical shape (First aspect)
10 Piston pump
11 Cylinder
11*a* Cylinder space
12 Piston
13 Suction port
14 Discharge port
15 Drive part
20 Suction valve (Needle valve)
21 Needle shaft
22 Gas introduction port
23 Drive part
30 Discharge valve (Needle valve)
31 Needle shaft
36 Drive part
40 Tank
41 Pressure pump
42 Flowmeter
43 Air intake port
44 Air filter
45 Mixer
46 Nozzle
47 Conduit
47*a* Conduit space
52 Conduit
60*a*, 60*b*, 60*c*, 60*d*, 60*e*, 60*f* Baffle plate (First aspect)
61 Baffle plate (Second aspect)
62 Through-hole

The invention claimed is:

1. An apparatus for mixing a paste material with gas, the apparatus comprising:

a mixing part that mixes the paste material with the gas using a piston pump; and a static mixer that is connected to the mixing part to stir a mixture obtained by mixing the paste material with the gas in the mixing part, wherein the static mixer includes one or more stirring sections through which the mixture passes, the one or more stirring sections having a shape that allows a flow of the mixture passing through the one or more stirring sections to be stirred, and further the static mixer is a static mixer according to any of a first aspect in which a ratio of a volume of the piston pump to a volume of at least one of the stirring sections of the static mixer is within a range from 1:0.2 to 1:5 and a second aspect in which at least one of the stirring sections has a configuration in which the flow of the mixture is split into five or more streams to stir the mixture of the paste material and the gas by a shear force, wherein the piston pump includes: a cylinder; a discharge port formed at an end of the cylinder in order to make the cylinder communicate with a conduit through which the paste material can flow; a suction port formed in the cylinder in order to fill the cylinder with gas; and a piston slidable between a first position and a second position inside the cylinder, wherein the mixing part includes a discharge valve that opens and closes the discharge port, the cylinder forms a cylinder space having a predetermined volume when the piston is located at the first position, and the static mixer is connected to the conduit.

2. The apparatus for mixing a paste material with gas according to claim 1, wherein the discharge port is provided so as to face a flow of the paste material in a side wall of the conduit, and the discharge valve includes a valve body that can extend from a position of the side wall of the conduit to seat at the discharge port, the position being opposed to the discharge port.

3. The apparatus for mixing a paste material with gas according to claim 1, wherein the one or more stirring sections of the static mixer includes static stirring means.

4. The apparatus for mixing a paste material with gas according to claim 3, wherein in the first aspect of the static mixer, the stirring means is operable to perform actions of splitting, turning and inverting of a flow of the mixture.

5. The apparatus for mixing a paste material with gas according to claim 4, wherein the stirring means has a helical shape.

6. The apparatus for mixing a paste material with gas according to claim 4, wherein the stirring means is a plurality of baffle plates that are alternately arranged in the static mixer against the flow of the mixture.

7. An apparatus for mixing a paste material with gas, the apparatus comprising:

a mixing part that mixes the paste material with the gas using a piston pump; and a static mixer that is connected to the mixing part to stir a mixture obtained by mixing the paste material with the gas in the mixing part, wherein the static mixer includes one or more stirring sections through which the mixture passes, the one or more stirring sections having a shape that allows a flow of the mixture passing through the one or more stirring sections to be stirred, and wherein the static mixer is a static mixer according to any of a first aspect in which a ratio of a volume of the piston pump to a volume of at least one of the stirring sections of the static mixer is within a range from 1:0.2 to 1:5 and a second aspect in which at least one of the stirring sections has a configuration in which the flow of the mixture is split into five or more streams to stir the mixture of the paste material and the gas by a shear force, wherein the piston pump includes: a cylinder; and a piston that reciprocates in the cylinder to perform a suction step and a discharge step, wherein the cylinder includes a valve for controlling discharge that is provided at a stroke end of the discharge step, a valve for controlling gas supply, and a valve for controlling paste material supply, and wherein a volume of the piston pump is a volume of an interior of the cylinder defined by the piston that is located at the stroke end in the suction step.

8. The apparatus for mixing a paste material with gas according to claim 7, wherein the mixing part is operable to execute each of the steps of:

supplying the gas to the piston pump in the suction step;

supplying the paste material after the suction step; and performing a discharge step of the piston pump after end of the supply of the paste material to discharge the gas and the paste material to a conduit.

9. An apparatus for mixing a paste material with gas, the apparatus comprising:

a mixing part that mixes the paste material with the gas using a piston pump; and a static mixer that is connected to the mixing part to stir a mixture obtained by mixing the paste material with the gas in the mixing part, wherein the static mixer includes one or more stirring sections through which the mixture passes, the one or more stirring sections having a shape that allows a flow of the mixture passing through the one or more stirring sections to be stirred, and at least one of the stirring sections has static stirring means including five or more flow paths by which to split into five or more streams to stir the mixture of the paste material and the gas by a shear force, each of the flow paths being arranged in parallel to the flow of the mixture.

10. An apparatus for mixing a paste material with gas, the apparatus comprising:

a mixing part that mixes the paste material with the gas using a piston pump; and a static mixer that is connected to the mixing part to stir a mixture obtained by mixing the paste material with the gas in the mixing part, wherein the static mixer includes one or more stirring sections through which the mixture passes, the one or more stirring sections having a shape that allows a flow of the mixture passing through the one or more stirring sections to be stirred, and wherein the static mixer is a static mixer according to any of a first aspect in which a ratio of a volume of the piston pump to a volume of at least one of the stirring sections of the static mixer is within a range from 1:0.2 to 1:5 and a second aspect in which at least one of the stirring sections has a configuration in which the flow of the mixture is split into five or more streams to stir the mixture of the paste material and the gas by a shear force, and wherein a pipe having a predetermined length is provided at least any of between the mixing part and the static mixer and between the static mixer and discharge means for discharging the mixture.

11. A method for mixing a paste material with gas, the method comprising the steps of:

mixing the paste material with the gas per batch; and arranging a static mixer in a flow path of a mixture obtained by mixing the paste material with the gas to stir the mixture, wherein the step of arranging a static mixer is set to be a step of arranging a static mixer that includes one or more stirring sections through which the mixture passes, the one or more stirring sections having a shape that allows a flow of the mixture passing through the one or more stirring sections to be stirred, and wherein the static mixer is a static mixer according to any of a first aspect in which a ratio of a volume of the mixture per batch to a volume of a first one of the stirring section through which the mixture at least initially passes among the stirring sections of the static mixer is within a range from 1:0.2 to 1:5 and a second aspect in which the flow of the mixture is split into five or more streams to stir the mixture of the paste material and the gas by a shear force, wherein the step of mixing the paste material and the gas per batch is set to be a step using a piston pump, wherein the piston pump includes: a cylinder; and a piston that reciprocates in the cylinder to perform a suction step and a discharge step, in which the cylinder includes a valve for controlling discharge that is provided at a stroke end of the discharge step, a valve for controlling gas supply, and a valve for controlling paste material supply, and wherein the volume of the mixture per batch is a volume of an interior of the cylinder defined by the piston that is located at the stroke end in the suction step.

12. The method for mixing a paste material with gas according to claim 11, wherein the step of mixing the paste material and the gas per batch is set to be a step using a discharge valve, and the piston pump further includes: a discharge port formed at an end of the cylinder in order to make the cylinder communicate with a conduit through which the paste material can flow; and a suction port formed in the cylinder in order to fill the cylinder with gas, wherein the piston is slidable between a first position and a second position inside the cylinder, and wherein the discharge valve is used for opening and closing the discharge port, the cylinder forms a cylinder space having a predetermined volume when the piston is located at the first position, and the static mixer is connected to the conduit.

13. The method for mixing a paste material with gas according to claim 12, further comprising the steps of:

closing the discharge port;

forming the cylinder space having a predetermined volume in the cylinder by moving the piston to the first position;

filling the cylinder space with gas having a predetermined pressure from the suction port;

compressing the gas by moving the piston toward the second position; and mixing the compressed gas into the paste material that flows through the conduit by opening the discharge port, wherein a series of steps from closing the discharge valve to opening the discharge valve is repeated whenever a predetermined amount of the paste material flows, the discharge port is provided so as to face a flow of high-viscosity material in a side wall of the conduit, and the step of closing the discharge port is set to be a step of extending a valve body from a position of the side wall of the conduit to seat the valve body at the discharge port, the position being opposed to the discharge port.

14. The method for mixing a paste material with gas according to claim 11, wherein the step of mixing the paste material and the gas per batch executes each of the steps of:

supplying the gas to the piston pump in the suction step: supplying the paste material after the suction step; and performing the discharge step of the piston pump after end of the supply of the paste material to discharge the gas and the paste material to a conduit.

15. The method for mixing a paste material with gas according to claim 11, wherein a step of arranging the static mixer includes a step of arranging a static mixer having static stirring means in the stirring section.

16. The method for mixing a paste material with gas according to claim 15, wherein the step of arranging a static mixer having the static stirring means includes a step of splitting, turning and inverting a flow of the mixture using the first aspect of the static mixer.

17. The method for mixing a paste material with gas according to claim 16, wherein the step of arranging a static mixer having the static stirring means uses stirring means having a helical shape.

18. The method for mixing a paste material with gas according to claim 16, wherein the stirring means is a plurality of baffle plates that are alternately arranged in the static mixer against the flow of the mixture.

19. The method for mixing a paste material with gas according to claim 13, wherein a foam ratio of the paste material is controlled by adjusting at least any of the predetermined amount of the paste material, the predetermined volume of the cylinder space, and a predetermined pressure of the gas.

20. A method for mixing a paste material with gas comprising the steps of:

mixing the paste material with the gas per batch; and arranging a static mixer in a flow path of a mixture obtained by mixing the paste material with the gas to stir the mixture, wherein the step of arranging a static mixer is set to be a step of arranging a static mixer that includes one or more stirring sections through which the mixture passes, the one or more stirring sections having a shape that allows a flow of the mixture passing through the one or more stirring sections to be stirred, and the static mixer has static stirring means in at least one of the stirring sections, the static stirring means including five or more flow paths by which to split into five or more streams to stir the mixture of the paste material and the gas by a shear force, each of the flow paths being arranged in parallel to the flow of the mixture.

* * * * *